United States Patent [19]

Nowicki

[11] Patent Number: 4,815,634

[45] Date of Patent: Mar. 28, 1989

[54] VACUUM ACTUATED PUMP

[75] Inventor: Michael L. Nowicki, House Springs, Mo.

[73] Assignee: Dema Engineering Co., St. Louis, Mo.

[21] Appl. No.: 32,054

[22] Filed: Mar. 27, 1987

[51] Int. Cl.[4] ..... E03C 1/04

[52] U.S. Cl. ..... 222/133; 222/309; 222/334; 222/129.2; 239/322; 4/628

[58] Field of Search ..... 222/133, 129.2, 309, 222/389, 334, 57; 417/181, 264, 392; 239/332, 329; 4/628, 638

[56] References Cited

U.S. PATENT DOCUMENTS

| | | | |
|---|---|---|---|
| 1,968,716 | 7/1934 | Smith | 417/181 |
| 2,153,519 | 4/1939 | Horton | 239/322 |
| 3,254,797 | 6/1966 | Porter | 222/57 |
| 3,810,391 | 5/1974 | Suovaniemi | 222/309 |

*Primary Examiner*—Joseph J. Wolf
*Assistant Examiner*—Nils E. Pedersen
*Attorney, Agent, or Firm*—Cohn, Powell & Hind

[57] ABSTRACT

A vacuum actuated chemical dispenser. The dispenser includes a chemical chamber and a vacuum chamber. The dispenser further includes a chemical chamber piston and a vacuum chamber piston located and movable within their respective chambers. A coil spring associated with the pistons returns the pistons to a pre-vacuum actuated position. The pistons are adjustable in order to adjust the measured amount of chemical to be dispensed from the chemical chamber.

19 Claims, 1 Drawing Sheet

TO SOAP SUPPLY

VACUUM ACTUATED PUMP

BACKGROUND OF THE INVENTION

This invention relates generally to a vacuum actuated chemical dispensing system, and more particularly, to a vacuum actuated detergent or chemical dispenser and a method of dispensing the chemical using a vacuum.

In conventional chemical dispensing systems for dispensing detergents and other chemical cleansers, a manually operated system is usually provided.

In a typical application, a hand operated soap dispenser is located over a sink in which dishes, glasses, pots and pans are washed. Dishwashing detergent usually maintains its detergent power for an extended period of time. Dishwashing detergent can be applied in measured amounts in order to obtain the greatest economic benefit.

Detergents and other chemical cleansers are often used indiscriminately in commercial and industrial establishments even though the quantity of detergent used can contribute a significant amount to the cost of doing business, for example, in restaurants or in industrial locations in which parts or components must be cleaned or degreased.

In other prior units, mixing units have been used to dilute or mix soap into a spray or stream of water as disclosed in U.S. Pat. Nos. 4,397,050 and 2,886,214. U.S. Pat. No. 4,090,964 discloses the use of both vacuum and pressure to operate a diaphragm to fill a metering chamber with acid and then discharge the acid into a water softener unit in a two step, vacuum then pressure, operation. A pressurized soap dispensing metering valve is disclosed in U.S. Pat. No. 3,640,435 in which a combination spring actuated faucet and a ball member movable within an inclined passage meters the amount of soap discharged through the faucet. U.S. Pat. No. 3,639,920 discloses a proximity apparatus associated with a wash basin to provide alternate wash, soap and rinse cycles with the use of a pump operated soap dispenser. U.S. Pat. No. 3,108,489 discloses a hand operated soap dispenser pump combined with a sink stopper linkage arrangement. Manual operated devices and soap mixing apparatus can be operated to dispense uncontrolled amounts of soap. Known metering devices are complicated by reliance on both a fluid pressure and a vacuum source or require an expensive modification or a complicated faucet mechanism.

The vacuum actuated chemical dispensing system of the present invention solves these and other problems in a manner not disclosed in the known prior art.

SUMMARY OF THE INVENTION

In the present vacuum actuated chemical dispensing system, means for producing and maintaining a vacuum for a selected period of time are connected to a vacuum actuated pump to provide actuating means for a piston means of the vacuum actuated pump. The piston means moves in response to the vacuum. Bias means returns the piston means to a pre-vacuum position. Movement of the piston means alternately dispenses a measured amount of chemical and fills the vacuum actuated pump with a measured amount of chemical which will be dispensed during the next piston means movement cycle. The stroke of the piston means may be adjusted to obtain a desired piston stroke thereby dispensing a desired quantity of chemical.

In a method of the present invention for actuating a chemical or soap dispenser with a vacuum, the steps of the method include producing a vacuum and communicating the vacuum to a vacuum chamber in the chemical or detergent dispenser. A vacuum chamber piston moves in response to the vacuum as does another piston connected to the vacuum chamber piston. The other piston is located in a chemical or detergent chamber to dispense at least some of the chemical or detergent therein. Eliminating the vacuum allows a bias means to return the vacuum chamber piston to its pre-vacuum position. Providing piston stroke adjustment means allows control of the amount of chemical or detergent to be dispensed the next time a vacuum is produced.

It is an aspect of the present invention that a vacuum actuated chemical dispensing system and method for dispensing a chemical in response to a vacuum are provided.

It is another aspect of the present invention that the chemical dispensing system provides adjustment means for varying the amount of chemical dispensed by adjusting the stroke of a piston operatively associated with a vacuum actuated pump.

It is another aspect of the present invention that a chemical dispensing system is provided for automatically dispensing a desired amount of chemical each time a vacuum is produced.

These and other aspects and features of the present invention will be better understood and appreciated from the following detailed description of an embodiment thereof, selected for the purpose of illustration and shown in the accompanying drawings.

DESCRIPTION OF THE PREFERRED EMBODIMENT

Figures 1, 2, 3:
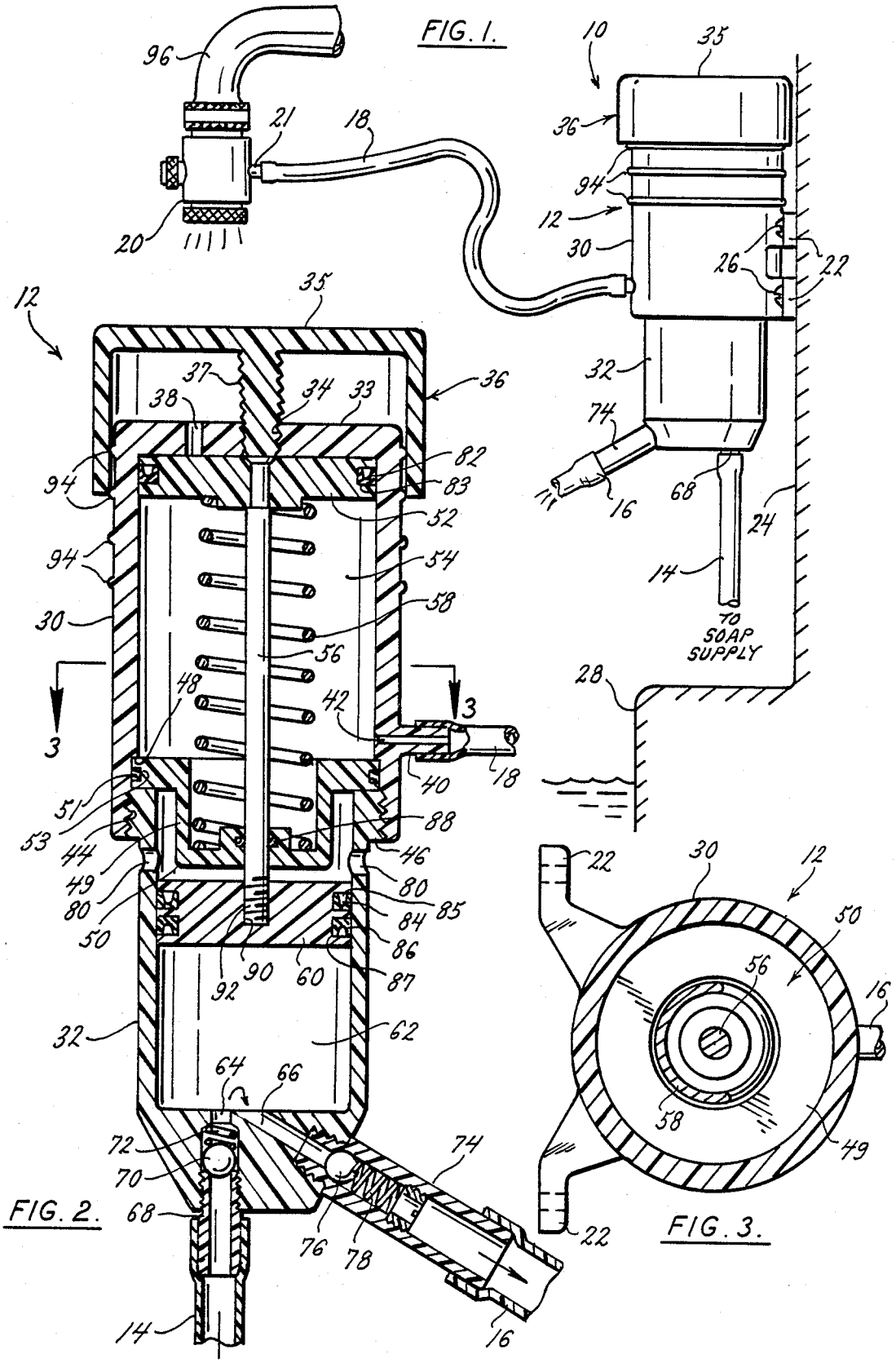
FIG. 1 is a schematic of one embodiment of a vacuum actuated chemical dispensing system of the present invention.
FIG. 2 is a cross sectional view of one embodiment of a vacuum actuated pump of the present invention.
FIG. 3 is a cross sectional view taken along line 3—3 of FIG. 2.

Referring now by characters of reference to the drawings and first to FIG. 1, it will be understood that a vacuum actuated chemical dispensing system 10 generally includes a vacuum actuated pump 12, chemical supply means 14 for a chemical to be dispensed, chemical discharge means 16 for the dispensed chemical, vacuum communication means 18 for communicating a vacuum created by vacuum producing means 20 to the vacuum actuated pump 12. The present invention can be used for a number of chemical dispensing applications in which a vacuum producing means is readily available. The preferred embodiment described herein has particular use for application where the chemical is a detergent, chemical cleaner or degreasing agent.

In detail, vacuum actuated pump 12 includes three external connections. A chemical supply tube 14 provides a supply line for chemical supply. The chemical supply tube 14 may be PVC tubing. A discharge line 16 is provided for the chemical dispensed from pump 12. A vacuum line 18 provides communication means between a faucet mounted proportioner 20 and pump 12. Vacuum line 18 may also be PVC tubing. Vacuum is produced by proportioner 20 when there is a flow of water through the proportioner and the proportioner is activated. The proportioner 20 is preferably an automatic reset type proportioner similar to Dema Model 151, 152, 153 or 154. The proportioner 20 includes vacuum connection 21. Vacuum line 18 connects to vacuum connection 21 in order to communicate the vacuum to pump 12.

A rack assembly 22 attaches pump 12 to a wall 24 or part of a sink 28 with fastening means 26 such as a plurality of threaded fasteners. The pump 12 is mounted over or near the sink 28 such that discharge line 16 can dispense the chemical from the pump 12 into sink 28.

Referring next to FIGS. 1 and 2, it will be understood that vacuum actuated pump 12 generally includes one portion, an upper portion 30 and another portion, a lower portion 32. An upper wall 33 includes a threaded bore 34. The threaded bore 34 receives a piston stroke adjustment means 36 including a cap member 35 and a depending threaded member 37 which is threadably received in bore 34. Wall 33 also includes a vent opening 38 which is partially protected by cap member 35.

Upper portion 30 of the pump includes a vacuum connection means 40 which in the preferred embodiment is a vacuum connection boss defining a vacuum communication passage 42. The upper portion 30 of pump 12 includes a threaded opening 44 for threadably receiving the lower portion 32 of pump 12. The threaded engagement between upper portion 30 and lower portion 32 of pump 12 extends to the limit of the threaded region 46 of the upper portion 30.

An annular shoulder 48 associated with upper portion 30 of pump 12 acts as a stop for a spring retaining assembly 49 for a bias means or spring means 58. The assembly includes a spring retaining cup 50 and sealing means 51 such as an O-ring held in an annular groove 53. Spring retaining assembly 49 is located intermediate lower portion 32 of pump 12 and annular shoulder 48 of upper portion 30 of pump 12.

Upper portion 30 of pump 12 defines a cylinder 54 which slidingly receives a piston means or vacuum chamber piston 52. The cylinder provides a vacuum chamber 54. The vacuum chamber piston 52 includes sealing means 82 located in an annular groove 83.

A connecting member 56 connects vacuum chamber piston 52 with another piston means 60. The other piston means 60 is slidably received in another cylinder or chemical chamber 62 defined by lower portion 32 of pump 12. The chemical chamber 62 provides a chemical chamber from which the chemical is dispensed through discharge line 16, for example, into sink 28.

In the embodiment shown, the spring retaining assembly 49 provides a means for separating the cylinder 54 from the other cylinder 62.

Intermediate the spring retaining assembly 49 and vacuum chamber piston 52 the bias means 58 is retained in spring retaining assembly 49 and acts to bias vacuum chamber piston 52 away from spring retaining assembly 49. A coil spring is used in the embodiment shown.

Chemical supply tube 14 communicates with the chemical chamber 62 through a chemical supply passage 64. Discharge line 16 communicates with the chemical chamber 62 through a chemical dispensing passage 66. Intermediate chemical supply passage 64 and chemical supply tube 14 one flow control means 68 engages the chemical supply passage 64. In the described embodiment the flow control means 68 includes a check valve threadably connected to a chemical supply passage 64. The check valve 68 includes a ball 70 and a spring 72 in combination thereby allowing chemical flow only into chemical chamber 62. Intermediate discharge line 16 and chemical dispensing passage 66 another flow control means 74 engages passages 66. In the described embodiment the other flow control means 74 includes another check valve threadably connected to chemical dispensing passage 66. The other check valve 74 also includes a ball 76 and spring 78 in combination allowing chemical flow only out of chemical chamber 62.

A plurality of vent holes 80 provided in lower portion 32 of pump 12 protect against cross connection between the chemical chamber 62 and the vacuum camber 54.

The chemical chamber piston 60 includes sealing means and in the described embodiment the sealing means includes a pair of seals 84, 86 located in annular grooves 85, 87 in piston 60.

Connecting member 56, as illustrated, is a piston rod, preferably plastic, connected to vacuum chamber piston 52 at one end and threadably received by chemical chamber piston threaded bore 90 of chemical chamber piston 60 at threaded end 92. Another sealing means 88, as illustrated and described, an O-ring retained by the spring retaining cup 50 allows sliding movement of rod 56 while maintaining vacuum chamber 54 capable of holding the vacuum necessary to operate vacuum pump 12.

Should sealing means 84 or 86 leak, then vent holes 80 will keep the chambers from becoming cross contaminated by providing a vent for the leaking chemical chamber.

Cap member 35 and depending threaded shaft 37 provide adjusting means for the stroke of pistons 52 and 60. Rotation of cap member 35 in a clockwise direction (for right hand threads) further engages depending threaded shaft 37 in threaded bore 34 and pushes both pistons 52 and 60, by means of rod 56, so as to reduce the relative volume of both the vacuum chamber 54 and chemical chamber 62. Counterclockwise rotation of cap member 35 provides an opposite effect by providing a relative increase in chamber volume.

A plurality of indicator means 94 such as notches, ridges or marks, provide reference marks for preset positions of cap member 35 and the stroke of pistons 52 and 60. For example, if three reference marks are used, then the top mark could indicate an amount of detergent for a full sink, the middle mark an amount of detergent for a half-full sink and the bottom mark an amount of detergent for a minimum amount of water in the sink.

In the operation of the preferred embodiment of the present invention a vacuum is produced by the automatic reset type proportioner 20. In the preferred embodiment, a Dema brand liquid proportioner, for example, Models 151, 152, 153 or 154 could be used with a properly sized spring to actuate the pump as required. The vacuum is produced in an understood manner when a flow of water passes through the proportioner, such as from a water faucet 96 to which the proportioner is operatively attached, and the proportioner is activated by pressing the push button on the side of the proportioner. The push button generally stays depressed while the water is running. When the water is turned off or stops the proportioner automatically resets and the vacuum created by the proportioner is discontinued until the sink filling cycle is repeated.

Communication of the vacuum from proportioner 20 to vacuum actuated pump 12 by vacuum line 18 provides a motive force for moving the vacuum chamber piston 52 in opposition to the bias of coil spring 58. Rod 56 connects vacuum chamber piston 52 to chemical chamber piston 60. As vacuum chamber piston 52 moves in response to the vacuum so does chemical chamber piston 60 within chemical chamber 62.

The pistons 52 and 60 move in response to the vacuum so as to reduce the relative volume of the respective chambers 54 and 62. As the volume of chemical chamber 62 decreases, the chemical within chamber 62 is forced out through chemical dispensing passage 66 and flow control means 74 which only allows for flow out of chemical chamber 62 by means of the check valve 74 in the preferred embodiment. The chemical is eventually dispensed, for example, into sink 28 through discharge line 16. In this way, sink 28 may be filled with water and the chemical, such as a detergent. Thus, the desired amount of chemical will be dispensed into the sink 28 only once each time the faucet is turned on. Thus, if the faucet is turned on only once to fill the sink, then only the desired amount of chemical will be dispensed.

The vacuum is discontinued when water stops flowing through proportioner 20. Discontinuing the vacuum removes resistance against the bias of coil spring 58. The coil spring 58 returns vacuum chamber piston 52 and chemical chamber piston 60 to a pre-vacuum actuated position As chemical chamber piston 60 returns to its pre-vacuum position the chemical chamber 62 volume increases, and because of the associated seals, a reduced pressure condition is created. As a result of the reduced pressure, chemical enters the chemical chamber 62 through chemical supply tube 14 and flow control means 68 which only allows flow into the chemical chamber 62 due to the ball 70 and spring 72 arrangement of check valve 68.

When the coil spring 58 has completely returned the vacuum chamber piston 52 to its pre-vacuum position, chemical chamber 62 has been filled with chemical and is prepared for the next cycle.

From the foregoing description those skilled in the art will appreciate that all of the aspects of the present invention are realized. A readily available vacuum has been used to actuate a pump to dispense a desired amount of a chemical, such as detergent or a chemical cleanser or degreaser into a sink. The amount of chemical dispensed may be varied with an adjustment means to adjust the stroke of a piston arrangement in the pump. The present invention controls the amount of chemical dispensed since the dispensing cycle operates only once when a faucet associated with the present invention is turned on, for example, to fill a sink.

While one embodiment has been shown, many variations are possible. For example, the arrangement of the components of the system may vary in appearance and shape. The location of the discharge line or chemical supply may vary and other flow control means may be used.

Other modifications may be made to the embodiment illustrated and described without departing from the spirit of the invention. It is not intended that the scope of this invention be limited to a particular embodiment. Rather, the scope of the invention is to be determined by the following claims and their equivalents.

What is claimed is:

1. A vacuum actuated chemical dispensing system associated with a sink and faucet comprising:

(a) means associated with the faucet for producing a continuous vacuum, (b) a vacuum actuated pump, (c) one cylinder defined by the pump, (d) another cylinder defined by the pump, (e) means for separating the one cylinder and the other cylinder, (f) a chemical supply passage operatively associated with the other cylinder, (g) a chemical dispensing passage operatively associated with the other cylinder, (h) vacuum connection passage operatively associated with the pump and the one cylinder, (i) vacuum communication means for communicating the vacuum created by the vacuum producing means to the one cylinder through the vacuum connection passage, (j) one piston means movable within the one cylinder in response to the continuous vacuum produced by the vacuum producing means, (k) another piston means movable within the other cylinder, (l) a connecting member for operatively connecting the one piston means and the other piston means, such that movement of the one piston means in response to the vacuum produced by the vacuum producing means results in corresponding movement of the other piston means, (m) bias means for retracting the one piston means and the other piston means to a pre-vacuum condition when the vacuum is discontinued, (n) a flow control means for allowing flow of the chemical into the other cylinder from a chemical supply, the flow control means operatively associated with the chemical supply passage, and (o) another flow control means for allowing continuous dispensing of a pre-determined amount of the chemical from the other cylinder, the other flow control means operatively associated with the chemical dispensing passage.

2. A vacuum actuated chemical dispensing system, as set forth in claim 1, further comprising:

(p) piston stroke adjustment means for adjusting the stroke of the connecting member.

3. A vacuum actuated chemical dispensing system, as set forth in claim 2, in which:

(q) the piston stroke adjustment means includes a threaded member threadably received by the vacuum actuated pump, the threaded member operatively associated with the connecting member such that movement of the threaded member while in operative association with the connecting member will increase or decrease the stroke of the connecting member.

4. The vacuum actuated chemical dispensing system of claim 1, in which:

(p) the vacuum producing means includes means operatively connected to a water faucet for producing a vacuum each time the water faucet is turned on and water flows through the vacuum producing means.

5. The vacuum actuated chemical dispensing system of claim 4, in which:

(q) the vacuum producing means includes a push button, automatic reset-type proportioner.

6. A vacuum actuated chemical dispensing system, as set forth in claim 1, wherein:

(p) the bias means includes a spring means.

7. A vacuum actuated chemical dispensing system, as set forth in claim 6, wherein:

(q) the spring means includes a coil spring.

8. A vacuum actuated chemical dispensing system, associated with a sink and faucet comprising:

(a) a push button actuated proportioner mounted on a water faucet, the proportioner producing a vacuum for a period of time only once each time the faucet is turned on, the proportioner including a proportioner vacuum connection, (b) a vacuum line in communication with the proportioner vacuum connection, (c) a vacuum actuated pump, (d) the pump including a vacuum chamber, the vacuum chamber including a vacuum connection passage for providing an operational connection for the vacuum line, (e) a vacuum piston movable within the vacuum chamber in response to the vacuum produced by the proportioner, (f) spring means for biasing the vacuum chamber piston to a first position, in opposition to the bias of the spring means by the vacuum communicated from the proportioner to the vacuum chamber, (g) a piston rod, one end of the piston rod attached to the vacuum chamber piston and movable with the vacuum chamber piston between the first position and the second position, (h) a chemical chamber defined by the vacuum actuated pump, (i) an end of the piston rod located within the chemical chamber for movement within the chemical chamber, (j) a chemical chamber piston located within the chemical chamber, the chemical chamber piston attached to the opposite end of the piston rod and movable within the chemical chamber as the piston rod and vacuum chamber piston move between the first position and the second position, the chemical chamber piston dispensing a chemical contained in the chemical chamber as chemical chamber piston moves from the first position to the second position, (k) a chemical supply passage providing communication for the chemical from a chemical supply to the chemical chamber, (l) a chemical supply check valve providing for chemical flow in only one direction from the chemical supply to the chemical chamber, (m) a chemical dispensing passage providing a passage for the chemical dispensed from the chemical chamber into a sink, and (n) a chemical dispensing check valve providing for flow in one direction only continuously from the chemical chamber into the sink to dispense a predetermined amount of chemical.

9. A vacuum actuated chemical dispensing system as set forth in claim 8, further comprising:

(o) a piston stroke adjustment means for adjusting the stroke of the combination of the vacuum chamber piston, chemical chamber piston, and piston rod so as to increase or decrease the stroke of the chemical chamber piston and the amount of chemical dispensed from the chemical chamber, 10. A vacuum actuated chemical dispensing system as set forth in claim 9, in which:

(p) the piston stroke adjustment means includes a threaded member threadably engaged with one portion of the vacuum actuated pump the threaded member operatively associated with the vacuum chamber piston such that the stroke of the vacuum chamber piston will vary in response to axial movement of the threaded member when operatively associated with the vacuum chamber piston, thereby adjusting the amount of chemical dispensed from the chemical chamber during the vacuum actuated stroke from the first position to the second position and chemical supplied to the chemical chamber from the chemical supply during the bias stroke to the first position from the second position.

11. A vacuum actuated chemical dispenser pumping system as set forth in claim 8, in which:

(o) the chemical supply check valve includes a ball-type check valve.

12. A vacuum actuated chemical dispenser as set forth in claim 8, in which:

(o) the chemical dispensing check valve includes a ball-type check valve.

13. A vacuum actuated pump for use in conjunction with a sink and faucet, the pump, comprising:

(a) one cylinder, (b) another cylinder, (c) a chemical dispensing passage operatively associated with the other cylinder, (d) vacuum connection passage operatively associated with the one cylinder and communicating with the faucet, (e) one piston movable within the one cylinder, (f) another piston movable within the other cylinder, (g) a connecting member operatively connecting the one piston with the other piston, (h) a chemical supply passage operatively associated with the other cylinder, (i) bias means biasing the connecting member to a biased position, thereby drawing the chemical into the other cylinder through the chemical supply passage, the connecting member movable to another position in response to a vacuum, thereby dispensing a pre-determined amount of the chemical in a continuous flow from the other cylinder through the chemical dispensing passage, (j) a flow control means operatively associated with the chemical supply passage for allowing flow of the chemical into the other cylinder from a chemical supply through the chemical supply passage, and (k) another flow control means operatively associated with the chemical dispensing passage for allowing flow of the chemical from the other cylinder through the chemical dispensing passage.

14. A vacuum actuated pump, as set forth in claim 13, further comprising:

(l) piston stroke adjustment means for adjusting the stroke of the connecting member.

15. A vacuum actuated pump, as set forth in claim 13, in which:

(l) the pump includes an upper portion defining the one cylinder, and (m) the pump includes a lower portion defining the other cylinder, the upper and lower portions separably connected.

16. A vacuum actuated pump, as set forth in claim 15, in which:

(n) the lower portion of the pump includes a plurality of vent holes to prevent cross-connection and possible contamination between the lower portion and the upper portion of the pump.

17. A vacuum actuated pump, as set forth in claim 13, in which:

(l) the flow control means includes a check valve, and (m) the other flow control means includes another check valve.

18. A method for operating a chemical dispensing system by a vacuum in the filling of a sink from a faucet, the method comprising the steps of:

(a) using the faucet for producing a vacuum, (b) communicating the vacuum to a vacuum chamber in a vacuum actuated pump, (c) moving a vacuum chamber piston within the vacuum chamber in response to the vacuum, (d) connecting the vacuum chamber piston to a chemical chamber piston in a chemical chamber, (e) dispensing a pre-determined amount of chemical in a continuous flow through a chemical dispensing flow control means in response to movement of the chemical chamber piston, (f) discontinuing the vacuum, (g) biasing the vacuum chamber piston to a pre-vacuum actuated position by a bias means, thereby moving the chemical chamber piston to its pre-vacuum actuated position, and (h) filling the now emptied chemical chamber from a chemical supply through a chemical supply flow control means in response to the chemical chamber piston being biased to its pre-vacuum actuated position along with the vacuum chamber piston by bias means.

19. A method for operating a chemical dispensing system by a vacuum as set forth in claim 18, further comprising the step of:

(i) controlling the amount of chemical dispensed by providing stroke adjustment means for adjusting the stroke of the vacuum chamber piston and the stroke of the chemical chamber piston.

* * * * *

UNITED STATES PATENT AND TRADEMARK OFFICE

CERTIFICATE OF CORRECTION

PATENT NO. : 4,815,634

DATED : March 28, 1989

INVENTOR(S) : Michael L. Nowicki

It is certified that error appears in the above-identified patent and that said Letters Patent is hereby corrected as shown below:

Column 7, line 16 between "vacuum" and "piston" insert --chamber--.

Column 7, line 20 after "position," insert --the vacuum chamber piston biased to a second position--

Signed and Sealed this

Twenty-sixth Day of September, 1989

*Attest:*

DONALD J. QUIGG

*Attesting Officer*

*Commissioner of Patents and Trademarks*